US005471021A

United States Patent [19]

Malesko

[11] Patent Number: 5,471,021

[45] Date of Patent: Nov. 28, 1995

[54] ACCELERATION SENSOR WITH LATERALLY-SUPPORTED BEAM CONTACTS

[75] Inventor: Michael W. Malesko, Ann Arbor, Mich.

[73] Assignee: Automotive Systems Laboratory, Inc., Farmington Hills, Mich.

[21] Appl. No.: 276,450

[22] Filed: Jul. 18, 1994

[51] Int. Cl.[6] ..... H01H 35/14; H01H 1/00

[52] U.S. Cl. ..... 200/61.45 R; 200/61.45 M; 200/61.53; 200/238; 200/275

[58] Field of Search ..... 200/61.45 R, 61.45 M, 200/61.53, 237–243, 275, 61.48–61.51; 73/517 R

[56] References Cited

U.S. PATENT DOCUMENTS

| | | | |
|---|---|---|---|
| 3,272,949 | 8/1964 | Lawrence | 200/243 |
| 4,221,940 | 9/1980 | Roth | 200/61.45 R |
| 4,922,065 | 5/1990 | Behr et al. | 200/61.45 M |
| 4,932,260 | 6/1990 | Norton | 73/517 R |
| 5,053,588 | 10/1991 | Bolender | 200/61.45 R |
| 5,149,925 | 9/1992 | Behr et al. | 200/61.45 M |
| 5,210,384 | 5/1993 | Shimozono et al. | 200/61.45 |
| 5,374,793 | 12/1994 | Shimozono et al. | 200/61.45 M |

*Primary Examiner*—J. R. Scott
*Attorney, Agent, or Firm*—Lyman R. Lyon

[57] ABSTRACT

An improved acceleration sensor (10) includes a housing (12) having an internal passage (14) defined therein, a sensing mass (18) located within the passage which moves from a first position within the passage towards a second position therein in response to acceleration inputs to the sensor housing, and a pair of electrical contacts (22) projecting into the passage so as to be bridged by the sensing mass when it reaches its second position within the passage, thereby closing an electrical circuit. The supported end (28) of each of the contacts includes diametrical arms (32) which are themselves secured to the housing only at their outboard ends (36). The arms are thus free to rotate elastically when the sensing mass deflects the contact's cantilevered free end (30), thereby permitting greater elastic travel of the contact's free end, with its enhanced reliability and an attendant increase in contact dwell.

6 Claims, 1 Drawing Sheet

ACCELERATION SENSOR WITH LATERALLY-SUPPORTED BEAM CONTACTS

BACKGROUND OF THE INVENTION

The invention broadly relates to electromechanical transducers which employ beam contacts to close an electrical circuit in response to a mechanical input. More specifically, the invention relates to acceleration sensors employing an inertial "sensing" mass which moves in response to acceleration from a first position within a passage to a second position therein, whereupon the sensing mass physically bridges a pair of beam contacts cantilevered into the passage.

Known cantilevered-beam contacts for use in acceleration sensors are typically stamped from a flat strip of metal and are nominally rectangular in cross-section. One end of each beam contact is securely mounted to an insulated portion of the accelerometer housing and otherwise electrically connected with an electrical lead extending from the housing. The other end or "free end" of each beam contact projects into the passage in order that it might make contact with an electrically-conductive surface on the sensing mass when the latter moves to the second position within the passage, whereby a circuit is closed to indicate such sensing mass movement.

Such known beam contacts are generally limited as to the amount of elastic travel that can be achieved at their free ends for a given package size, since each contact experiences elastic strain only along that portion of its length which actually projects into/across the passage. Moreover, such known beam contacts exhibit a tendency to take on a permanent set, i.e., experience plastic strain, when deflected by the sensing mass in the event of a substantial acceleration input to the accelerometer housing. Another common problem inherent to such known beam contacts is failure through the mechanism of fatigue, particularly where the sensor is used as a "safing" sensor, with its relatively lower threshold and correlatively frequent contact closure.

SUMMARY OF THE INVENTION

It is the object of the invention to provide a cantilevered beam contact for use in an acceleration sensor featuring greater elastic travel at its free end than known cantilevered beam contacts.

Another object of the invention is to provide an acceleration sensor which features an increased resistance to fatigue than is typical of known cantilevered beam contacts.

An improved acceleration sensor includes a housing having an internal passage defined therein about a first axis, a sensing mass located within the passage which moves in response to acceleration from a first position within the passage to a second position therein, and a pair of electrical contacts projecting into the passage so as to be bridged by a conductive surface on the sensing mass when the sensing mass reaches its second position within the passage, thereby closing an electrical circuit. In accordance with the invention, each of the contacts comprises a cantilevered beam, the supported end of which includes diametrical, outwardly-extending arms which are themselves secured to the housing only at their out-board ends. The outwardly-extending arms flex in torsion when the mass otherwise deflects the free end of the cantilevered beam upon contact therewith, thereby providing greater elastic travel of the beam's free end, enhanced reliability, and an attendant increase in contact dwell.

BRIEF DESCRIPTION OF THE DRAWINGS

In the drawings, in which like reference numerals are employed to designate like components in the various views.

DETAILED DESCRIPTION OF THE PREFERRED EMBODIMENT

The invention broadly relates to electromechanical transducers which employ beam contacts to close an electrical circuit in response to a mechanical input. For illustrative purposes, however, the apparatus of the invention will be described in detail in connection with an accelerometer, such as might be used to trigger deployment of a vehicle safety restraint in the event of a crash or marked vehicle deceleration.

Figure 1:
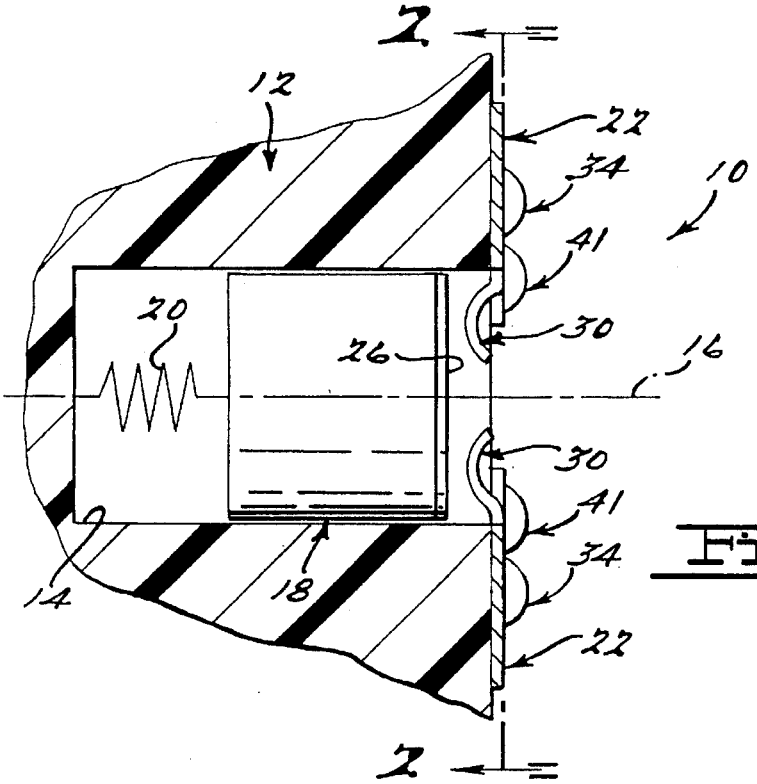
FIG. 1 is a longitudinal view in cross-section of an improved acceleration sensor constructed in accordance with the invention.

Referring initially to FIG. 1, an improved acceleration sensor 10 constructed in accordance with the invention includes a housing 12 having a cylindrical passage 14 formed therein about a first axis 16. An inertial sensing mass 18 located within the passage 14 is nominally biased to a first or "rest" position within the passage 14 by suitable biasing means known to one of ordinary skill in the art, illustrated schematically in FIG. 1 by a spring 20. The sensing mass 18 is movable within the passage 14 along the first axis 16 from its first position to a second position therein in response to application of an acceleration input to the housing 12 along the first axis 16.

Figure 2:
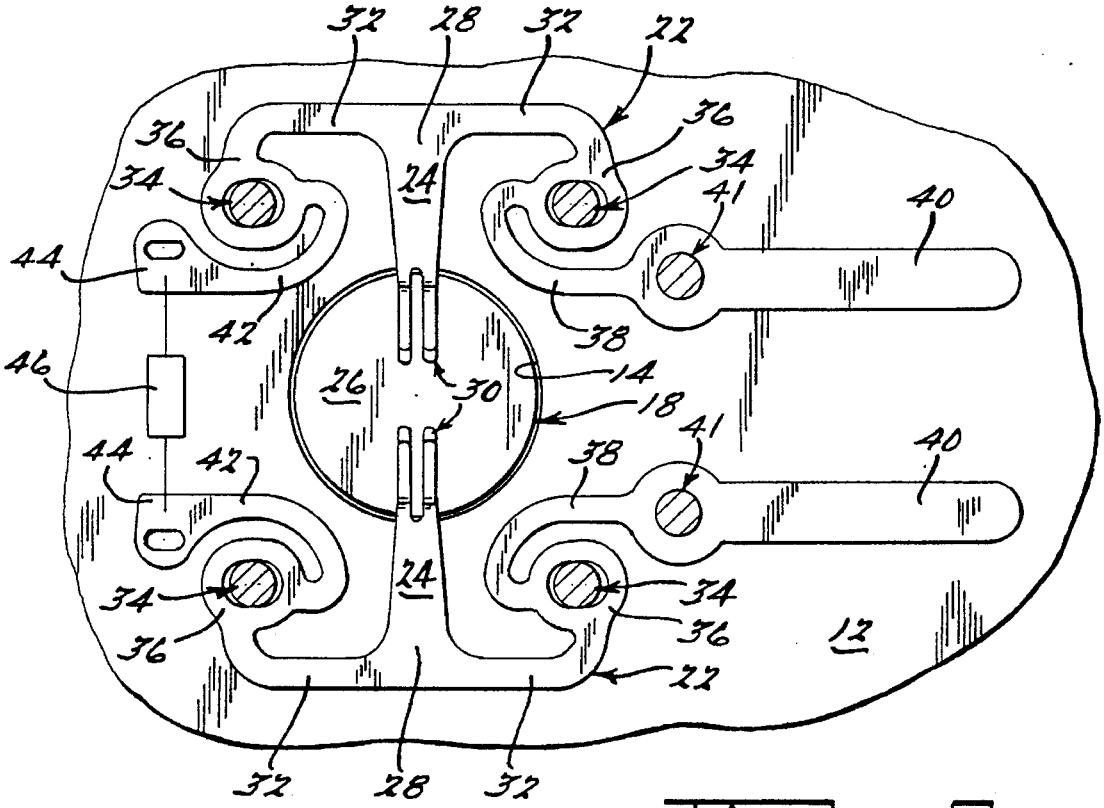
FIG. 2 is a side elevational view, partially in crosssection, of the improved acceleration sensor shown in FIG. 1 along line 2—2 thereof.

Referring now to both FIGS. 1 and 2, the acceleration sensor 10 further comprises a pair of elongate electrically-conductive contacts 22, or "beam contacts 22", a cantilevered portion 24 of each of which projects into the passage 14 so as to be bridged by an electrically-conductive surface 26 on the sensing mass 18 when the sensing mass 18 moves to its second position within the passage 14. More specifically, each beam contact 22 has a supported end 28 secured to the housing 12 proximate to the passage 14 therein and a cantilevered free end 30 projecting into the passage 14 such that the electrically-conductive surface 26 on the sensing mass 18 makes contact with the cantilevered free end 30 of each beam contact 22 when the sensing mass moves to its second position in the passage 14. In the preferred embodiment, each beam contact 22 is stamped from a thin sheet of a suitable material, such as a sheet of beryllium-copper, perhaps 0.075 mm thick.

In accordance with the invention, and in contrast with known beam contacts, the supported end 28 of each of the beam contacts 22 includes a pair of lateral arms 32 which extend outwardly in diametrically-opposite directions, each preferably being substantially perpendicular to the direction in which the beam contact's cantilevered free end 30 extends. Still further, in accordance with the invention, each of the arms 32 is secured to the housing 12 as by a threaded fastener 34 only at the outboard end 36 thereof, with the supported end 28 of each beam contact 22 not otherwise being secured to the housing 12 intermediate the outboard ends 36 of the arms 32. A first, nonload-bearing projection 38 extends from the outboard end 36 of one of the arms 32 of each beam contact 22 to provide a first land 40 to which a respective external lead (not shown) may be connected. Threaded fasteners 41 pass through and support the respective land 40. A second, nonload-bearing projection 42 extends from the outboard end 36 of the other one of the arms 32 of each beam contact 22 to provide a second land 44 to which the respective lead of a diagnostic resistor 46 may be attached, for use by diagnostic means in the manner known to one of ordinary skill in the art.

Under the invention, the free end 30 of each cantilevered beam contact 22 achieves greater elastic travel through contact flexure both in bending along the length of its cantilevered portion 24, and in torsion in each of its lateral arms 32. Indeed, in a preferred embodiment, the spring rate of the cantilevered portion 24 of each beam contact 22 is balanced with the torsional spring rate of its lateral arms 32 so that each experiences a quantitatively-similar amount of elastic strain for a given amount of travel of the beam contact's free end 30. The greater elastic travel of the cantilevered beam contact's free end 30 provides greater contact dwell while further ensuring greater reliability through lessened contact susceptibility to fatigue.

In accordance with another feature of the invention, the outboard end 36 of each arm 32 "curls back" in the direction in which the cantilevered portion 24 of the beam contact 22 extends. This curling back of the outboard end 36 of each arm 32 further reduces the possibility of a fatigue failure of the beam contact 22 proximate to the point at which each of its lateral arms 32 is secured to the housing 12, i.e., near each arm's outboard end 36.

While the preferred embodiment of the invention has been disclosed, it should be appreciated that the invention is susceptible of modification without departing from the spirit of the invention or the scope of the subjoined claims. For example, while the acceleration sensor described hereinabove features a pair of opposed cantilevered beam contacts 22 constructed in accordance with the invention, it will be readily appreciated that the sensor may alternatively feature a single beam contact 22 constructed in accordance with the invention in combination with an electrically-conductive surface of the passage 14 to form the "contacts" to be bridged by the sensing mass 18 when it reaches its second position within the passage 14.

I claim:

1. In an acceleration sensor having:

a housing having an internal passage formed therein about a first axis;

a sensing mass within said passage, said sensing mass being movable along said first axis from a first position to a second position therein in response to application of an acceleration input to said housing along said first axis, said sensing mass having an electrically-conductive surface thereon; and an elongate electrically-conductive beam contact having a supported end secured to said housing and a free end extending in a first direction into said passage such that the electrically-conductive surface on said sensing mass contacts the free end of said beam contact when said sensing mass moves to said second position, the improvement wherein:

the supported end of said beam contact includes a pair of diametrical arms, each of the arms being secured to the housing only at an outboard end thereof, with the supported end of said beam contact not otherwise being secured to said housing intermediate the outboard ends of the arms.

2. The acceleration sensor of claim 1, wherein the arms on the supported end of said beam contact extend outwardly in opposite directions, each substantially perpendicular to the first direction in which the free end of said beam contact extends.

3. The acceleration sensor of claim 2, wherein the outboard end of each of the arms curls back so as to further extend in the first direction in which the free end of said beam contact extends.

4. An improved electrical contact for use in an electromechanical transducer, said transducer having a housing and an element which moves from a first position relative to said housing towards a second position relative to said housing in response to an input to said transducer, said element having an electrically-conductive surface, said contact comprising:

an elongate electrically-conductive cantilevered beam having a supported end and a free end, wherein the free end of said beam extends in a first direction so as to engage the electrically-conductive surface of said element when said element moves to said second position, and wherein the supported end of said beam contact includes a pair of diametrical arms, each of the arms being secured to the housing only at an outboard end thereof, with the supported end of said beam contact not otherwise being secured to said housing intermediate the outboard ends of the arms.

5. The beam contact of claim 4, wherein the arms on the supported end of said beam contact initially extend in opposite directions, each substantially perpendicular to the first direction in which the free end of said beam contact extends.

6. The beam contact of claim 5, wherein the outboard end of each of the arms curls back so as to further extend in the first direction in which the free end of said beam extends.

* * * * *